US009813790B1

(12) United States Patent
Zhang et al.

(10) Patent No.: US 9,813,790 B1
(45) Date of Patent: Nov. 7, 2017

(54) MICROPHONE PACKAGE

(71) Applicants: Rui Zhang, Shenzhen (CN); Ting Kang, Shenzhen (CN)

(72) Inventors: Rui Zhang, Shenzhen (CN); Ting Kang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/416,101

(22) Filed: Jan. 26, 2017

(30) Foreign Application Priority Data

Oct. 25, 2016 (CN) ..... 2016 2 1163372 U

(51) Int. Cl.
*H04R 1/02* (2006.01)
*H04R 1/06* (2006.01)
*H04R 19/04* (2006.01)

(52) U.S. Cl.
CPC ..... *H04R 1/028* (2013.01); *H04R 1/06* (2013.01); *H04R 19/04* (2013.01); *H04R 2201/003* (2013.01)

(58) Field of Classification Search
CPC ..... H04R 19/005; H04R 19/04; H04R 1/04; H04R 17/02; H04R 19/016; H04R 1/406; H04R 1/222; H04R 1/342; H04R 29/004; H04R 11/04; H04R 21/02; H04R 2410/00; H04R 9/08; H04R 1/1041; H04R 1/326
See application file for complete search history.

(56) References Cited

U.S. PATENT DOCUMENTS 9,319,764 B2 * 4/2016 Chen ..... H04R 1/04
2009/0243058 A1 * 10/2009 Shirasaka ..... H04R 1/06 257/670
2009/0243060 A1 * 10/2009 Saitoh ..... G01D 11/245 257/676
2010/0183181 A1 * 7/2010 Wang ..... H04R 19/005 381/361

* cited by examiner

*Primary Examiner* — Mohammad Islam
(74) *Attorney, Agent, or Firm* — Na Xu; IPro, PLLC

(57) ABSTRACT

A microphone package includes a housing; a control circuit chip accommodated in the housing; a micro-electromechanical chip accommodated in the housing; and a circuit board forming an accommodation space with the housing. The circuit board includes a substrate, a rigid conductive layer disposed on the substrate and a plurality of conductive pads on the substrate for connecting to the control circuit chip. The micro-electromechanical chip and the control circuit chip are mounted on the rigid conductive layer, and the rigid conductive layer is provided with a number of isolation holes for receiving the conductive pads.

8 Claims, 2 Drawing Sheets

MICROPHONE PACKAGE

FIELD OF THE PRESENT DISCLOSURE

The present disclosure relates to the field of microphones, and more particularly to a microphone package.

DESCRIPTION OF RELATED ART

A microphone related to the present disclosure generally includes a circuit board, a housing, a micro-electromechanical chip, a control circuit chip etc. The circuit board and the housing enclose an encapsulation chamber (accommodation space) of the microphone. The micro-electromechanical chip and the control circuit chip are mounted on the circuit board and located in the encapsulation chamber.

When the circuit board and the housing are in the package, the pressure from the outside of the package leads to deformation of the circuit board easily, when serious, it may lead to the damage or failure of the micro-electromechanical chip, the control circuit chip and other.

Thereof, it is necessary to disclose and provide an improved microphone package to overcome the above-mentioned disadvantages.

BRIEF DESCRIPTION OF THE DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figures and the embodiments. It should be understood the specific embodiments described hereby are only to explain this disclosure, not intended to limit this disclosure.

Figure 1:
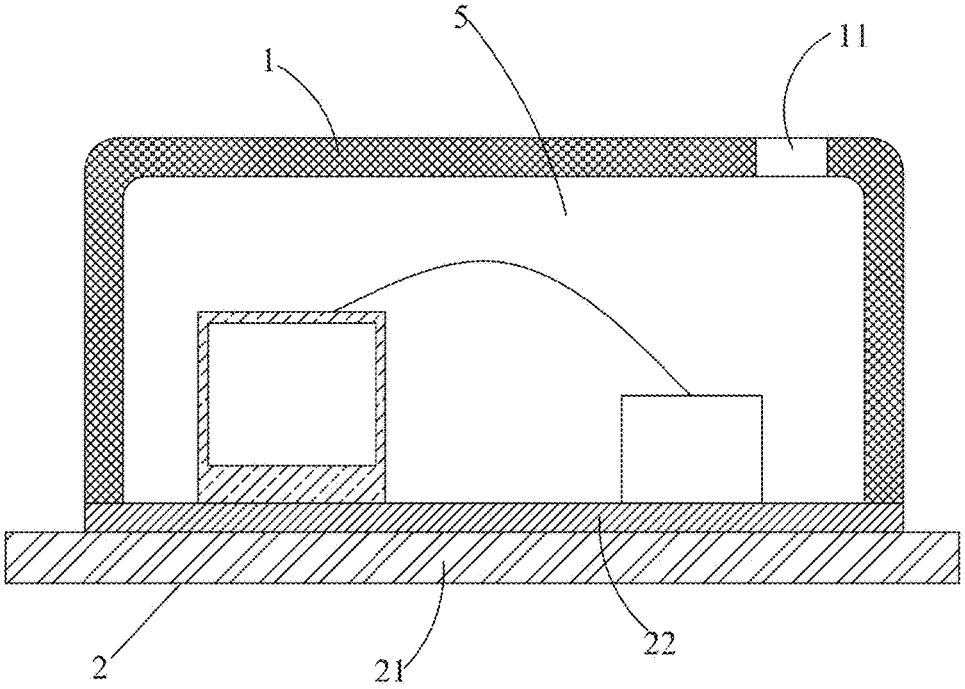
FIG. 1 is a cross-sectional view of a microphone package in accordance with a first exemplary embodiment of the present disclosure.
Figure 2:
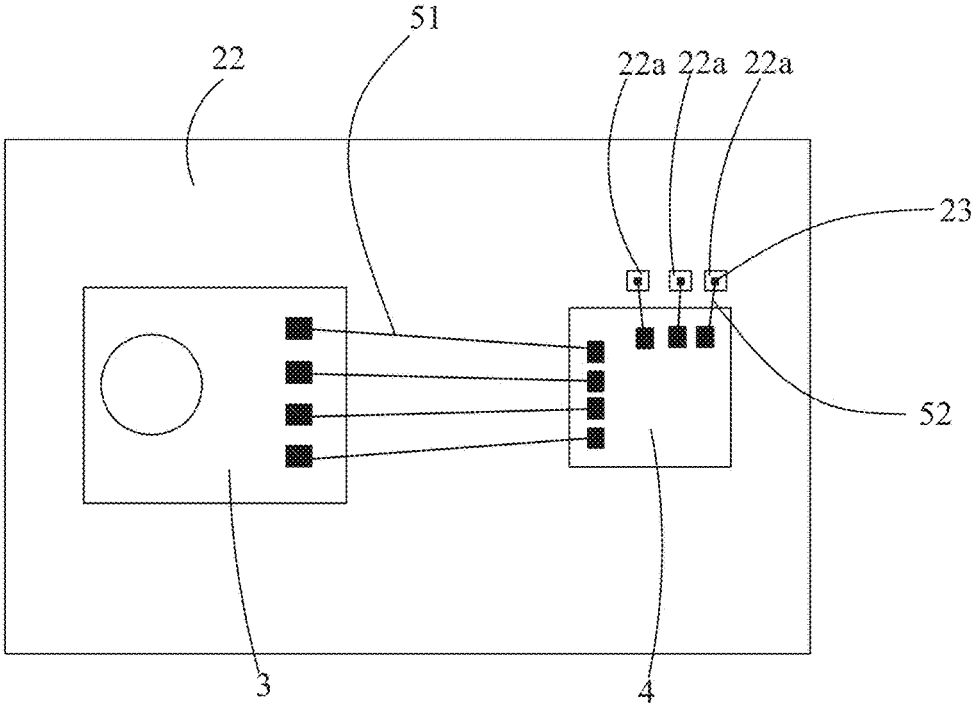
FIG. 2 is a top view of the microphone package in FIG. 1

Referring to FIGS. 1-2, a microphone package in accordance with a first exemplary embodiment of the present disclosure includes a housing 1, a circuit board 2, a micro-electromechanical chip 3, a control circuit chip 4, a first lead wire 51 and a second lead wire 52. The first lead wire 51 connects the micro-electromechanical chip 3 and the control circuit chip 4 electrically, and the second lead wire 52 connects the control circuit chip 4 with the circuit board 2 electrically.

The micro-electromechanical chip 3 is a MEMS (Micro-Electro-Mechanical System) chip, and the MEMS chip 3 may be a MEMS microphone chip or a pressure sensor chip.

The control circuit chip 4 is an ASIC (Application Specific Integrated Circuit) chip, and both the micro-electromechanical chip 3 and the control circuit chip 4 are mounted on the circuit board 2 and are electrically connected to each other by the first lead wire 51. The control circuit chip 4 is mainly used for a series of processes, such as the amplification of an electrical signal output from the micro-electromechanical chip 3, and for subsequent processing.

The housing 1 and the circuit board 2 cooperatively form an accommodation space 5. The micro-electromechanical chip 3 and the control circuit chip 4 are mounted on the circuit board 2 and located in the accommodation space.

The housing 1 is provided with a sound hole 11 for receiving sound waves into the accommodation space 5. Optionally, the housing 1 is made of metal material.

The circuit board 2 comprises a substrate 21, a rigid conductive layer 22 disposed on the substrate 21, and a plurality of conductive pads 23 formed on the substrate 21 for being electrically connected to the ASIC chip through the second lead wire 52. The rigid conductive layer 22 includes an isolation hole 22*a* only penetrating the rigid conductive layer 22, and not the substrate 21. Therefore, the isolation hole 22*a* forms an isolation region on the circuit board 2. The conductive pads 23 are located in the isolation holes 22*a* at a distance from each other to avoid the occurrence of electrical connection between the conductive pads 23.

The rigid conductive layer 22 is laminated on the substrate 21 so that the strength of the circuit board 2 is increased. When the package pressure or exterior force acts on the circuit board 2, the rigid conductive layer 22 can reduce the deformation of the circuit board 2, and lower the damage risk of the micro-electromechanical chip 3 and the control circuit chip 4. In the present embodiment, the rigid conductive layer 22 may be selectively provided as a solid copper layer, although the rigid conductive layer may also be a metal layer of the other materials.

The isolation holes 22*a* provided on the rigid conductive layer 22 can form a one-piece isolated area on the circuit board 2, which is in communication with each other; and each of the conductive pads 23 is disposed within the isolated and connected area, and each of the pads is spaced apart from another.

The rigid conductive layer 22 is provided with a plurality of isolation holes 22*a* which are not in communication with each other, and a plurality of isolation areas are formed correspondingly. This arrangement allows each of the conductive pads 23 to be individually provided in the isolation hole 22*a* with the separate isolation spaces, thereby ensure a more reliable isolation among the conductive pads 23, and reduce further the risk of electrical connection.

In particular, the shape of the isolation hole 22*a* may be various, such as a square shape, a circular shape, and the like. Optionally, the shape of the isolation hole 22*a* is compatible with the shape of the conductive pads 23 located in the isolation hole 22*a*. In this way, the isolation hole 22*a* can be opened with the reference of the shape of the conductive pads 23, so that the isolation hole 22*a* and the conductive pads 23 are better matched to facilitate the subsequent processing and manufacturing of the circuit board 2.

In order to reduce the interference of the external electromagnetic signal to the elements in the accommodation space 5, the housing 1 and the rigid conductive layer 22 can be connected, when the housing 1 and the circuit board 2 are closed, the devices located in the accommodation space 5 will have less interference from the electromagnetic signal from the outside under the action of the shielding of the housing 1 and the rigid conductive layer 22. The housing 1 is a metal case, the shielded space formed by the rigid conductive layer 22 and the metal-made housing 1 has a better shielding function, the performance of the device (for example, the sensor) in the microphone package is improved, and the performance of the microphone package is to be further enhanced.

Specifically, as shown in FIG. 1, the rigid conductive layer 22 is sandwiched between the housing 1 and the substrate 21 so that the housing 1 abuts on the rigid conductive layer 22 to form the accommodation space 5.

Figure 3:
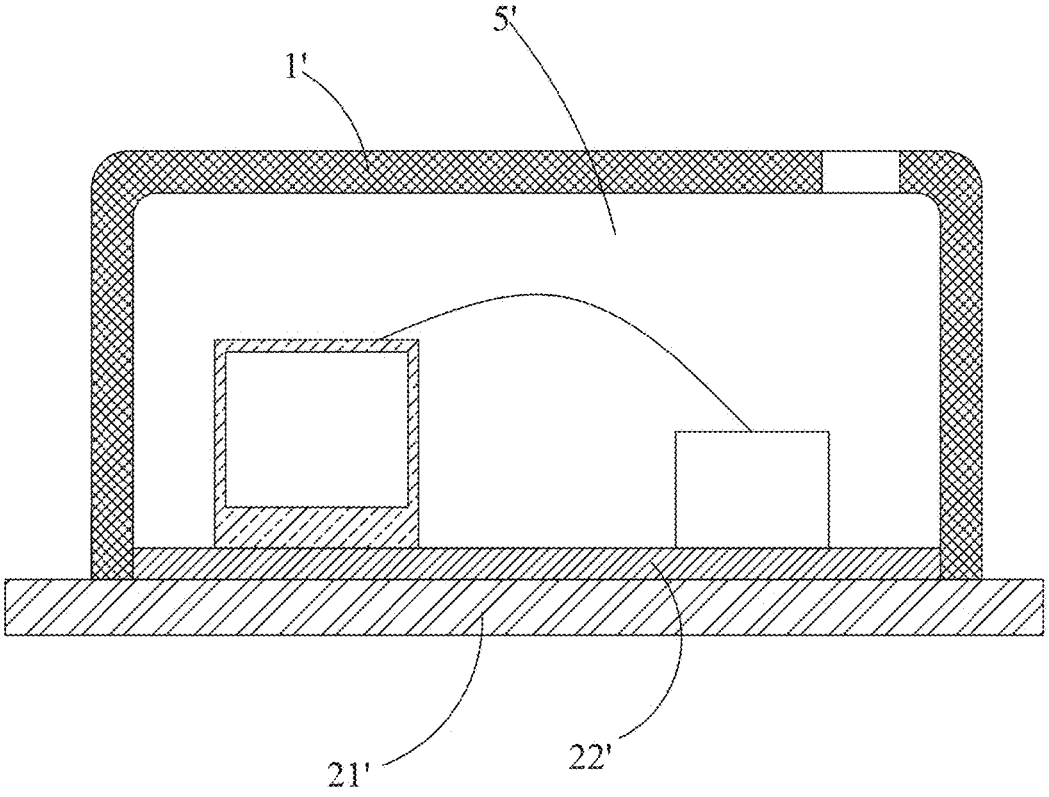
FIG. 3 is a cross-sectional view of a microphone package in accordance with a second exemplary embodiment of the present disclosure.

As shown in FIG. 3, a microphone package in accordance with a second exemplary embodiment is disclosed. The housing 1' is in contact with the substrate 21' to form the accommodation space 5', which is a closed shield space, and the rigid conductive layer 22' is completely housed in the accommodation space 5' and laid on the substrate 21', and the edge of the rigid conductive layer 22' is in contact with the housing 1'.

The isolation hole 22*a* may also be filled with an insulating medium, for example, the insulating medium is provided around each of the conductive pads so as to form a separate isolation space, each of the conductive pads is provided in separate isolation spaces to avoid electrical connection.

Based on the above structure, the present application also provides an electronic device including a microphone package, which is any microphone package according to the above-described arrangements, and the electronic device may be a mobile phone, a computer, or the like.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A microphone package, including:

a housing;

a control circuit chip accommodated in the housing;

a micro-electromechanical chip accommodated in the housing;

a circuit board forming an accommodation space with the housing, and including a substrate, a rigid conductive layer disposed on the substrate and a plurality of conductive pads on the substrate for connecting to the control circuit chip; wherein the micro-electromechanical chip and the control circuit chip are mounted on the rigid conductive layer, and the rigid conductive layer is provided with a plurality of isolation holes for receiving the conductive pads.

2. The microphone package as described in claim 1, wherein the shape of each of the isolation holes is corresponding to the shape of the conductive pads located within the isolation holes.

3. The microphone package as described in claim 1, wherein the rigid conductive layer is a solid copper layer.

4. The microphone package as described in claim 1, wherein the isolation hole is filled with an insulating medium.

5. The microphone package as described in claim 1, wherein the housing is made of metal material, and the housing is connected to the rigid conductive layer.

6. The microphone package as described in claim 5, wherein the rigid conductive layer is sandwiched between the housing and the substrate.

7. The microphone package as described in claim 6, wherein the rigid conductive layer is accommodated in the accommodation space, and an edge of the rigid conductive layer abuts against the housing.

8. The microphone package as described in claim 1 further including a first lead wire for electrically connecting the micro-electromechanical chip and the control circuit chip, and a second lead wire for electrically connecting the control circuit chip to the conductive pads.

* * * * *